US010363449B2

(12) United States Patent
Scott et al.

(10) Patent No.: US 10,363,449 B2
(45) Date of Patent: Jul. 30, 2019

(54) EXERCISE DEVICES AND SYSTEMS

(71) Applicant: Cambelle Limited, Timaru (NZ)

(72) Inventors: David Kim Scott, Feilding (NZ); Malcolm Lewis Brown, Palmerston North (NZ); Cameron Russell Sims, Auckland (NZ)

(73) Assignee: Campbelle Limited, Timaru (NZ)

( * ) Notice: Subject to any disclaimer, the term of this patent is extended or adjusted under 35 U.S.C. 154(b) by 205 days.

(21) Appl. No.: 15/500,829

(22) PCT Filed: Jul. 24, 2015

(86) PCT No.: PCT/NZ2015/050096
§ 371 (c)(1),
(2) Date: Jan. 31, 2017

(87) PCT Pub. No.: WO2016/018159
PCT Pub. Date: Feb. 4, 2016

(65) Prior Publication Data

US 2017/0216652 A1 Aug. 3, 2017

Related U.S. Application Data

(60) Provisional application No. 62/031,931, filed on Aug. 1, 2014.

(51) Int. Cl.
*A63B 21/068* (2006.01)
*A61H 1/02* (2006.01)
(Continued)

(52) U.S. Cl.
CPC ..... *A63B 21/068* (2013.01); *A61H 1/0229* (2013.01); *A63B 21/00072* (2013.01);
(Continued)

(58) Field of Classification Search
CPC ..... A61H 1/0229; A63B 21/00072; A63B 21/023; A63B 21/0421; A63B 21/0615;
(Continued)

(56) References Cited

U.S. PATENT DOCUMENTS 42,516 A * 4/1864 Taylor ..... A61H 1/02 601/24
2,050,500 A * 8/1936 Osborn ..... A63G 13/08 472/104
(Continued)

FOREIGN PATENT DOCUMENTS

CA 2280303 2/2001
CN 204319649 U 5/2015
(Continued)

OTHER PUBLICATIONS

European Search Report for EP Application No. PCT/NZ2015/050096 dated Mar. 21, 2018 (5 pages).
(Continued)

*Primary Examiner* — Joshua Lee
(74) *Attorney, Agent, or Firm* — Merchant & Gould P.C.

(57) ABSTRACT

An exercise device includes a pivot adjustably positioned at an intermediate point along the length of an elongate support element. One or more lower body supports are mounted on the elongate support element on a first side of the pivot and one or more upper body supports mounted on the elongate support on a second side of the pivot. The device may be used in push up, sit up, inverted pull up or leg raise modes.

20 Claims, 17 Drawing Sheets

(51) Int. Cl.

| | |
|---|---|
| ***A63B 21/00*** | (2006.01) |
| ***A63B 21/02*** | (2006.01) |
| ***A63B 21/04*** | (2006.01) |
| ***A63B 22/16*** | (2006.01) |
| ***A63B 23/02*** | (2006.01) |
| ***A63B 23/12*** | (2006.01) |

(52) U.S. Cl.
CPC ..... *A63B 21/023* (2013.01); *A63B 21/0421* (2013.01); *A63B 21/4015* (2015.10); *A63B 21/4031* (2015.10); *A63B 21/4047* (2015.10); *A63B 22/16* (2013.01); *A63B 23/0211* (2013.01); *A63B 23/0216* (2013.01); *A63B 23/0222* (2013.01); *A63B 23/1218* (2013.01); *A63B 23/1236* (2013.01)

(58) Field of Classification Search
CPC ..... A63B 21/0616; A63B 21/0617; A63B 21/068; A63B 21/4015; A63B 21/4031; A63B 21/4047; A63B 22/16; A63B 23/0211; A63B 23/0216; A63B 23/0222; A63B 23/1218; A63B 23/1236
See application file for complete search history.

(56) References Cited

U.S. PATENT DOCUMENTS

| | | | | |
|---|---|---|---|---|
| 4,136,868 | A * | 1/1979 | Hogue | A63B 21/00047 482/145 |
| 4,241,915 | A * | 12/1980 | Noble | A63B 21/00047 482/140 |
| 4,583,731 | A * | 4/1986 | Crivello | A63B 23/025 482/130 |
| 4,822,039 | A * | 4/1989 | Gonzales | A63B 21/04 482/128 |
| 4,915,101 | A | 4/1990 | Cuccia | |
| 4,951,939 | A * | 8/1990 | Peters | A63B 21/0615 482/94 |
| 5,518,487 | A | 5/1996 | Hallmark | |
| 5,752,879 | A | 5/1998 | Berdut | |
| 5,888,181 | A * | 3/1999 | Yeh | A63B 23/00 482/131 |
| 5,913,758 | A * | 6/1999 | Nunez | A61H 1/0292 482/140 |
| 6,663,547 | B1 | 12/2003 | Hughes | |
| 6,932,749 | B2 | 8/2005 | Barnes et al. | |
| 7,060,014 | B2 | 6/2006 | Bergman | |
| 7,942,795 | B2 | 5/2011 | Harris | |
| 8,430,799 | B2 | 4/2013 | Tussy | |
| 9,022,911 | B2 * | 5/2015 | Goldberg | A63B 21/04 482/123 |
| 2002/0022558 | A1 | 2/2002 | Casey | |
| 2002/0147087 | A1 * | 10/2002 | Tollner | A63B 22/16 482/147 |
| 2005/0101441 | A1 * | 5/2005 | Rosborough | A63B 22/16 482/51 |
| 2007/0027010 | A1 * | 2/2007 | Tsai | A63B 21/0004 482/146 |
| 2007/0032358 | A1 | 2/2007 | Chen | |
| 2008/0045390 | A1 | 2/2008 | Harms | |
| 2010/0022362 | A1 | 1/2010 | MacDonald | |
| 2010/0279838 | A1 | 11/2010 | Teeter et al. | |
| 2011/0009250 | A1 | 1/2011 | Barringer | |
| 2011/0098163 | A1 | 4/2011 | Radzwill | |
| 2011/0218086 | A1 | 9/2011 | Boren | |
| 2012/0302413 | A1 | 11/2012 | Katz | |
| 2014/0066276 | A1 * | 3/2014 | Hornback | A63B 21/068 482/145 |

FOREIGN PATENT DOCUMENTS

| | | |
|---|---|---|
| KR | 20-2010-0002590 | 3/2010 |
| WO | 2013177709 | 12/2013 |

OTHER PUBLICATIONS

International Written Opinion for International Application No. PCT/NZ2015/050096 dated Nov. 17, 2015 (8 pages).
International Search Report for International Application No. PCT/NZ2015/050096 dated Nov. 17, 2015 (7 pages).
International Preliminary Report on Patentability for International Application No. PCT/NZ2015/050096 dated Jul. 7, 2016 (16 pages).

* cited by examiner

EXERCISE DEVICES AND SYSTEMS

This application is a National Stage Application of PCT/NZ2015/050096, filed 24 Jul. 2015, which claims benefit of U.S. Ser. No. 62/031,931, filed 1 Aug. 2014 and which applications are incorporated herein by reference. To the extent appropriate, a claim of priority is made to each of the above disclosed applications.

FIELD OF THE INVENTION

The invention relates to exercise devices.

BACKGROUND TO THE INVENTION

Exercise devices are widely used to provide resistance to a user's movement. For example, free weight exercises involve movements against a resistance provided by a weighted bar. Fixed weights machines are also widely used. These devices are often large and unwieldy. Weights machines occupy a large footprint and have a high capital cost.

Exercise devices can also be used to reduce the resistance to a movement. For example, devices have been suggested to assist the user's upwards motion during a push up exercise. However, prior devices have been unduly complex, costly and difficult to use. Prior devices have also relied on the use of springs or added weights. Adjustment of the resistance or assistance level has been unduly difficult.

US20110009250A1 discloses a device for assisting a user to perform pushups. The device applies an upwards force to the user's torso to reduce the resistance to the push up movement. This device includes a torso support component that is mounted on a base. Elastic bands are used to provide the upwards force on the torso support component.

CA2280303A1 discloses a device for assisting users to perform push-ups. This device includes a bench that supports the entire length of the user's body. The bench is secured to a frame by a mounting. A compression spring or gas spring is used to provide an upwards force on the bench.

U.S. 20100022362A1 discloses a push up device that uses added weights on a rocker frame to assist a push up movement. The device is unwieldy and likely to be uncomfortable during use. Further, users are required to lift weights into position.

U.S. Pat. No. 7,060,014 B2 discloses a support platform for performing push-ups. The platform rotates around a mounting. A torsion spring is provided to alter the resistance level.

The prior art devices are all relatively complex and rely on weights, elastic bands or springs to alter the resistance level. Adjustment of resistance requires addition or removal of weights, or adjustment of a spring mechanism. Further, these devices are of heavy, costly construction.

Reference to any prior art in this specification does not constitute an admission that such prior art forms part of the common general knowledge.

It is an object of the invention to provide an improved exercise aid device, or at least to provide the public with a useful choice.

SUMMARY OF THE INVENTION

In a first aspect the invention provides an exercise device, including: an elongate support element; a pivot adjustably positioned at an intermediate point along the length of the elongate support element; one or more lower body supports mounted on the elongate support element on a first side of the pivot; and one or more upper body supports mounted on the elongate support on a second side of the pivot.

Preferably the pivot is provided by a pivot body including a ground bearing surface and being configured to support the elongate support element above the ground, such that, in use, the elongate support and pivot body move together in a pivoting or rolling motion.

Preferably the ground bearing surface is a non-slip bearing surface.

Preferably the ground bearing surface is a substantially cylindrical surface.

Alternatively the ground bearing surface is a substantially ellipsoidal surface. The exercise device may include one or more removable auxiliary pivot body units configured to convert the ellipsoidal ground bearing surface to a cylindrical surface.

Preferably the pivot body is configured to releasably engage with the elongate support such that the position of the pivot body along the length of the elongate support can be adjusted.

Preferably the pivot body is configured to engage with the elongate support at any one of a plurality of fixed positions arranged along the length of the elongate support.

Preferably the exercise device includes one or more resistance indicators indicative of the exercise resistance level as a function of pivot position along the length of the elongate support.

Preferably at least one of the upper and lower body supports has a position that is adjustable along the length of the elongate support.

Preferably the elongate support has a fixed length.

Alternatively the elongate support has an adjustable length.

Preferably the elongate support has at least one region of upwards curvature along its length.

Preferably, in use as a push-up aid device, a user adopts a downward-facing position with the user's body arranged along the length of the elongate support element, the user's lower body positioned on one or more of the lower body supports and the user's upper body supported on one or more of the upper body supports.

Preferably, in use as a sit-up device, a user sits on one or more of the upper body supports with the user's body arranged along the length of the elongate support element and the user's feet positioned beneath or secured to one or more of the lower body supports.

This aspect also extends to an inclined pull up aid system including an exercise aid device as defined above and one or more overhead grips, wherein, in use, a user adopts an upwards-facing position with the user's body arranged along the length of the elongate support element, the user's lower body positioned on one or more of the lower body supports, the user's upper body supported on one or more of the upper body supports and the user's hands gripping the overhead grips. Preferably the one or more overhead grips are supported on an overhead framework.

Preferably the device is configurable as a push up aid. Preferably the device is configurable as a sit up device. Preferably the device is configurable as an inverted pull up device.

Preferably all assistance to user motion is derived from body weight and/or from fixed weight of components of the device.

Preferably the one or more lower body supports include a footrest.

Preferably the one or more upper body supports include a first support having a position that is adjustable along the elongate support element. Preferably the one or more upper body supports include a second support, the first support being positioned between the second support and the pivot.

Preferably the device includes a repetition counter.

In another aspect the invention provides an exercise device including: a handle; two or more wheels rotatably mounted on the handle, the wheels being spaced apart such that a portion of the handle between the wheels is accessible to a user's hand; an asymmetric support arrangement; wherein in a first orientation, in use, the user's weight will be applied through the handle to the wheels; and wherein in a second orientation the support arrangement extends downwards beyond the circumference of the wheels such that, in use, the user's weight will be applied through the handle to the support arrangement.

Preferably the asymmetric support arrangement has a fixed position relative to the handle.

Preferably the asymmetric support arrangement includes a stable base wider then a width of the handle.

BRIEF DESCRIPTION OF THE DRAWINGS

The invention will now be described by way of example only, with reference to the accompanying drawings, in which.

DETAILED DESCRIPTION

Figure 1:
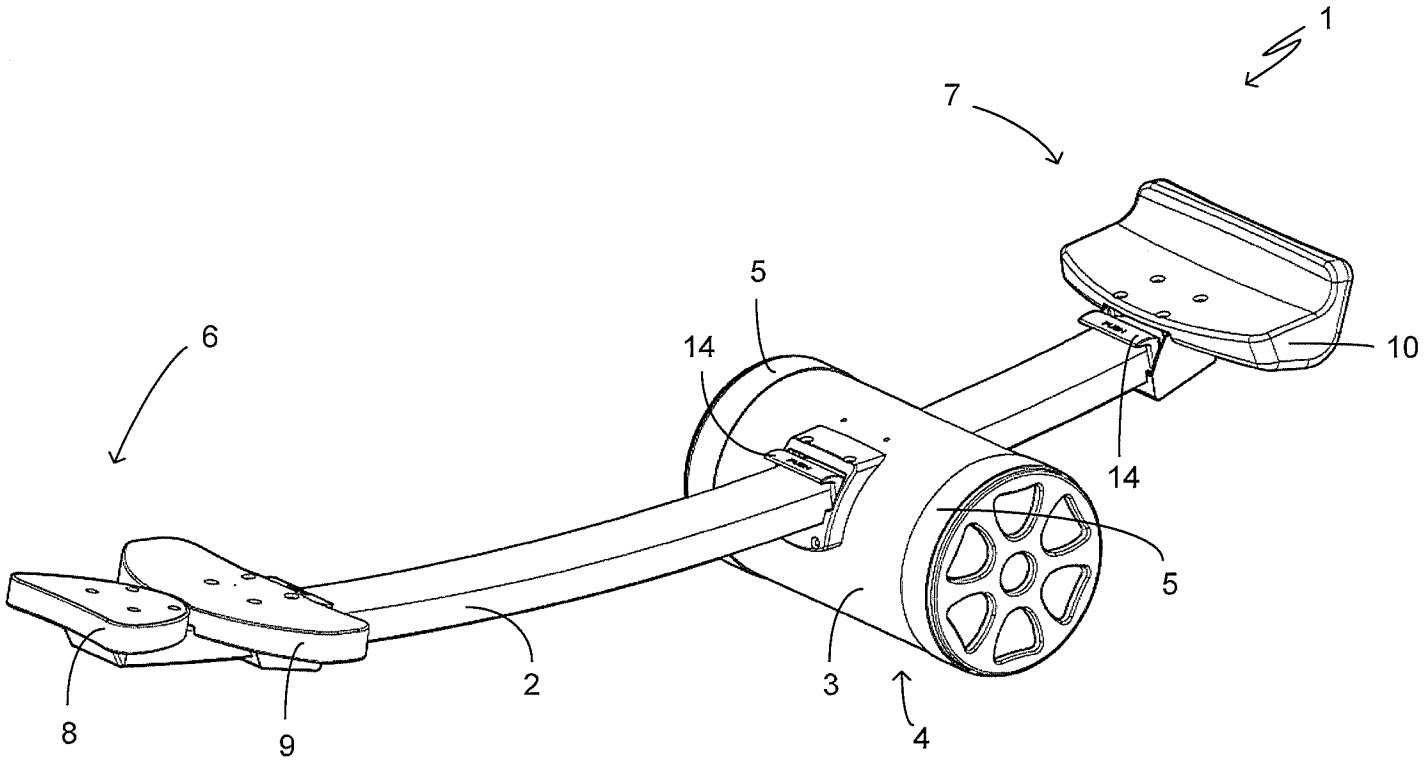
FIG. 1 shows an exercise device according to one embodiment.

FIGS. 1 to 5 show an exercise device 1 according to one embodiment. The device 1 may include an elongate support 2, on which other parts of the device 1 are mounted. The elongate support as shown is preferably a single beam or bar. However in some embodiments two or more elongate elements may be used, or an elongate plate or the like may be used.

The device may include a pivot body 3, the underside of which provides a ground bearing surface 4. The pivot body 3 engages with and supports the elongate support element 2. In FIGS. 1 to 5 the pivot body 3 is generally cylindrical and the ground bearing surface 4 is a cylindrical surface. However, other shapes are possible, as will be discussed below. The pivot body 3 supports the elongate support element 2 above the ground. In use, the elongate support and pivot body move together in a pivoting or rolling motion. The ground bearing surface 4 may be a non-slip surface, with a rubber or rubber-like surface layer or coating. In the embodiment shown a pair of thin rubber "tyres" 5 is applied to the pivot body 3 to provide this non-slip ground bearing surface 4.

The device 1 may also include one or more upper body supports 6 positioned on a first side of the pivot body 3 and one or more lower body supports 7 positioned on the other side of the pivot body 3, with these supports all being mounted on the elongate support element 2. In the embodiment shown there are two upper body supports 8, 9 and one lower body support in the form of a footrest 10. However, other numbers of upper or lower body supports may be provided, including any suitable combination of head rests, torso supports, core supports, buttock supports, knee rests, foot rests etc. These supports may be fixed or adjustable in position. Adjustable rests allow changes for user height, body shape and gender. Further adjustable rests allow, for example, a relatively weak user's core to be supported during an exercise, while for a stronger user the rest can be moved away from the core region.

Figure 2:
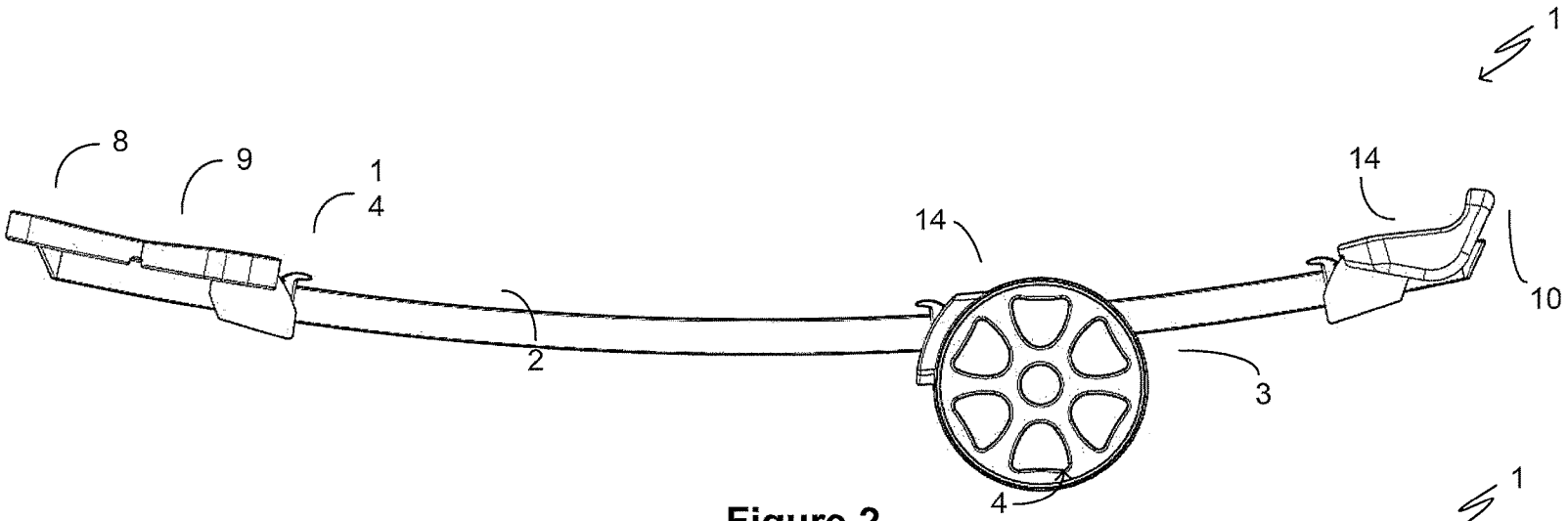
FIG. 2 is a side view of the device of FIG. 1.
Figure 3:
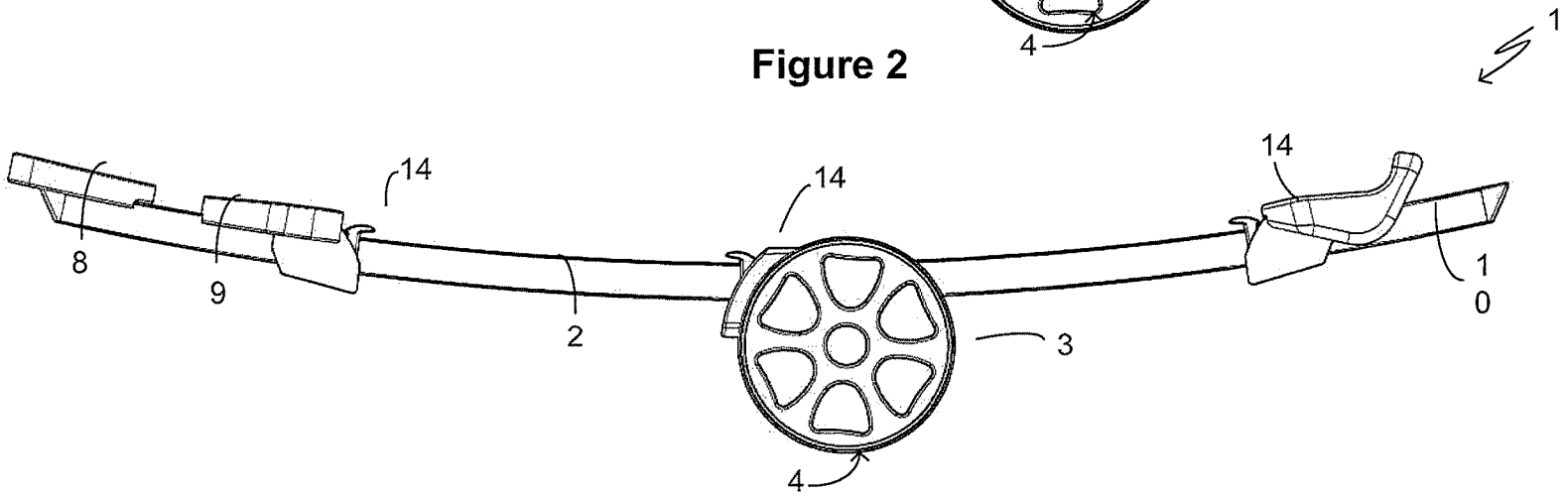
FIG. 3 is a further side view of the device of FIG. 1, illustrating the adjustable positions of some components.

FIGS. 2 and 3 illustrate the adjustable positions of the pivot body 3, first upper body support 9 and footrest 10 along the length of the elongate support element.

Figure 5:
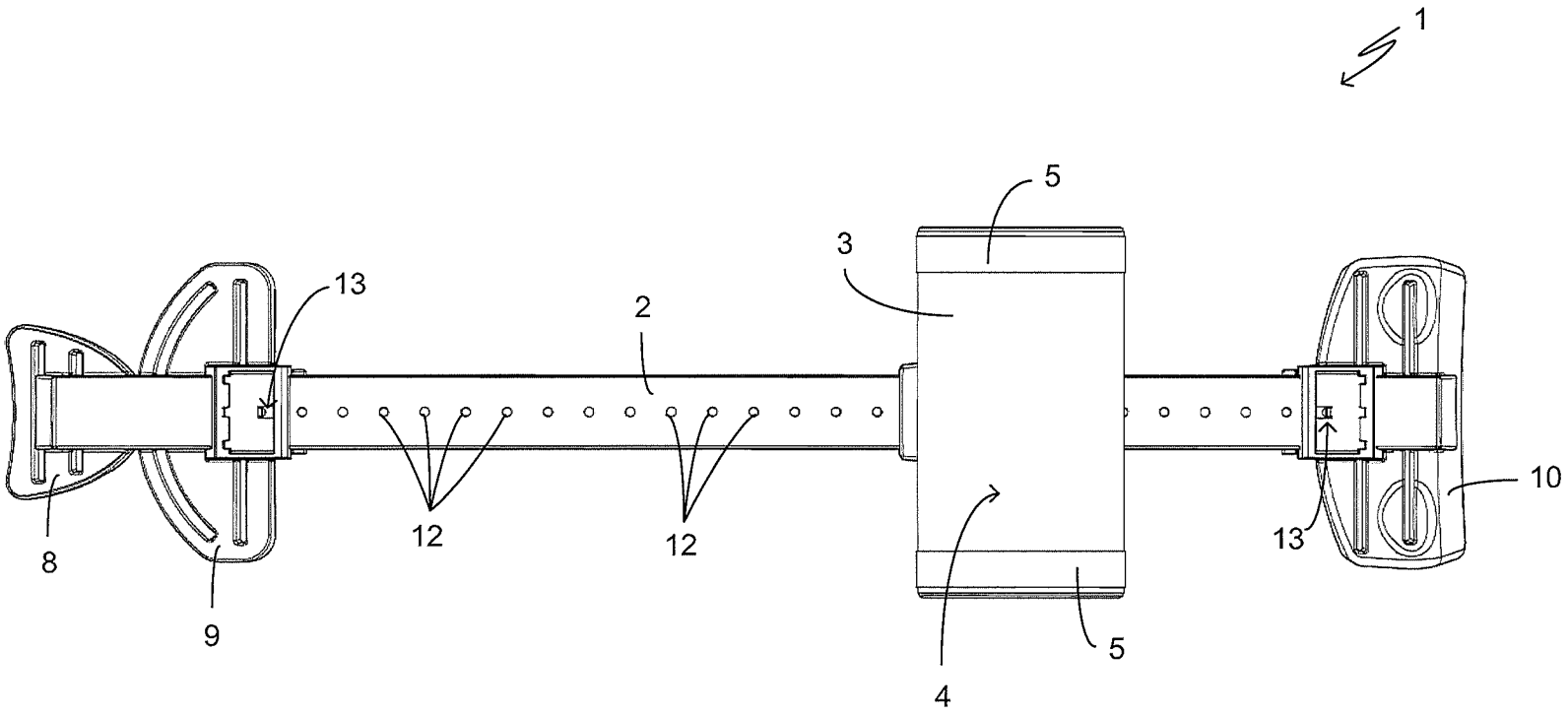
FIG. 5 is a bottom view of the device of FIG. 1.

As shown in the underside view of FIG. 5, the elongate support may be formed with a series of holes, apertures, notches or other formations 12 that provide a number of incremental positions in which the pivot body 3, first upper body support 9 and footrest 10 may be fixed. Each of the pivot body 3, first upper body support 9 and footrest 10 includes an engagement element 13 that releasably engages with a formation 12 to fix the position of the pivot body 3, first upper body support 9 or footrest 10.

In other embodiments the pivot body 3, first upper body support 9 and footrest 10 may be continuously adjustable, with no incremental positions. In this case, each of the pivot body 3, first upper body support 9 and footrest 10 may include a suitable clamping mechanism (such as a cam-lock clamp, friction clamp or any other suitable mechanism) for clamping to the elongate support element.

Each of the pivot body 3, first upper body support 9 and footrest 10 may include an actuator 14, which may be actuated by a user to release the engagement element 13 in order to allow adjustment of the position of the pivot body 3, first upper body support 9 or footrest 10. As shown the actuator may be a handle or lever, but any suitable arrangement may be used.

Figure 4:
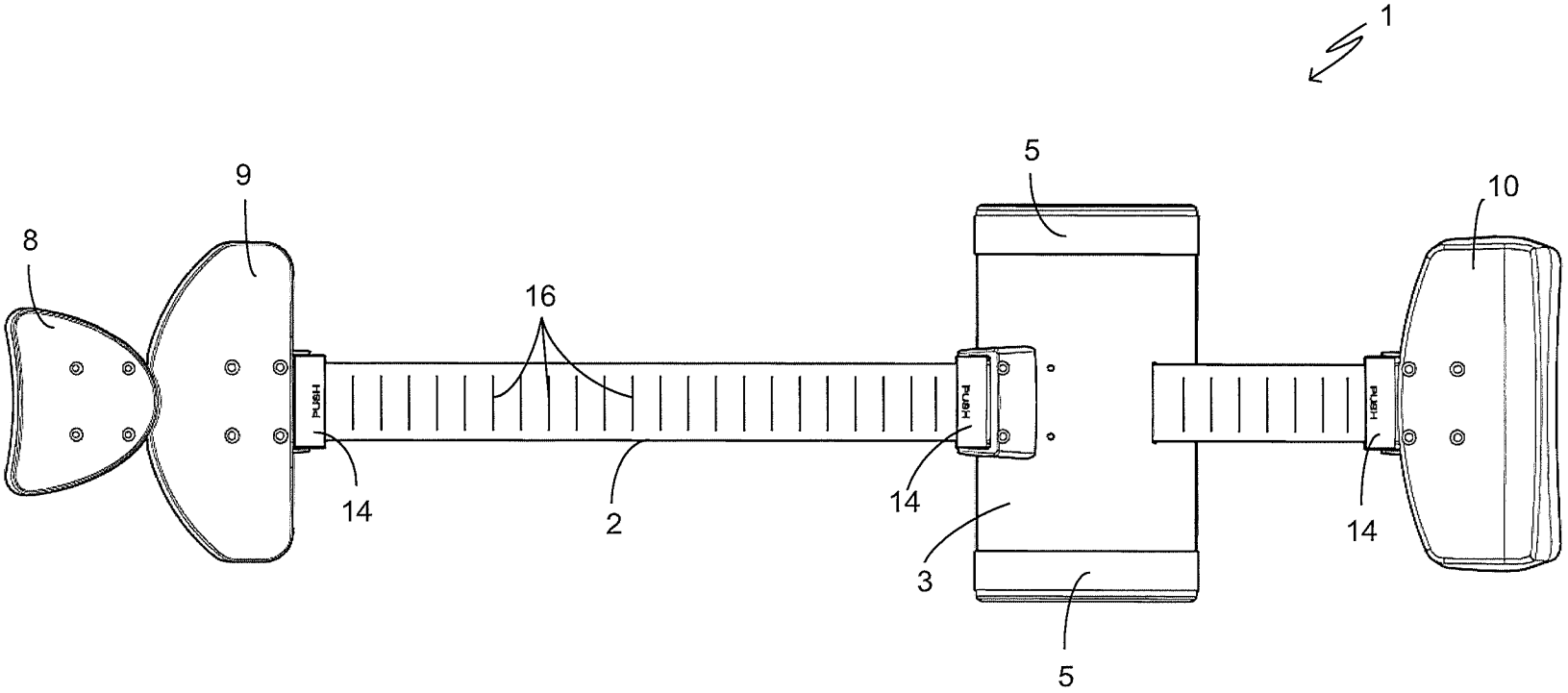
FIG. 4 is a top view of the device of FIG. 1.

As shown in FIG. 4, a scale 16 may be marked on the elongate support element. The scale may be indicative of the resistance level provided by a particular position of the pivot body 3 along the length of the elongate support element 2. Any suitable indicators may be used, including spaced gradations as shown, or coloured indicators where the colour changes along the length, for example from green (indicating a low resistance or high level of assistance) through orange (indicating a mid-level resistance or assistance) to red (indicating a high resistance or low level of assistance).

Figure 6:
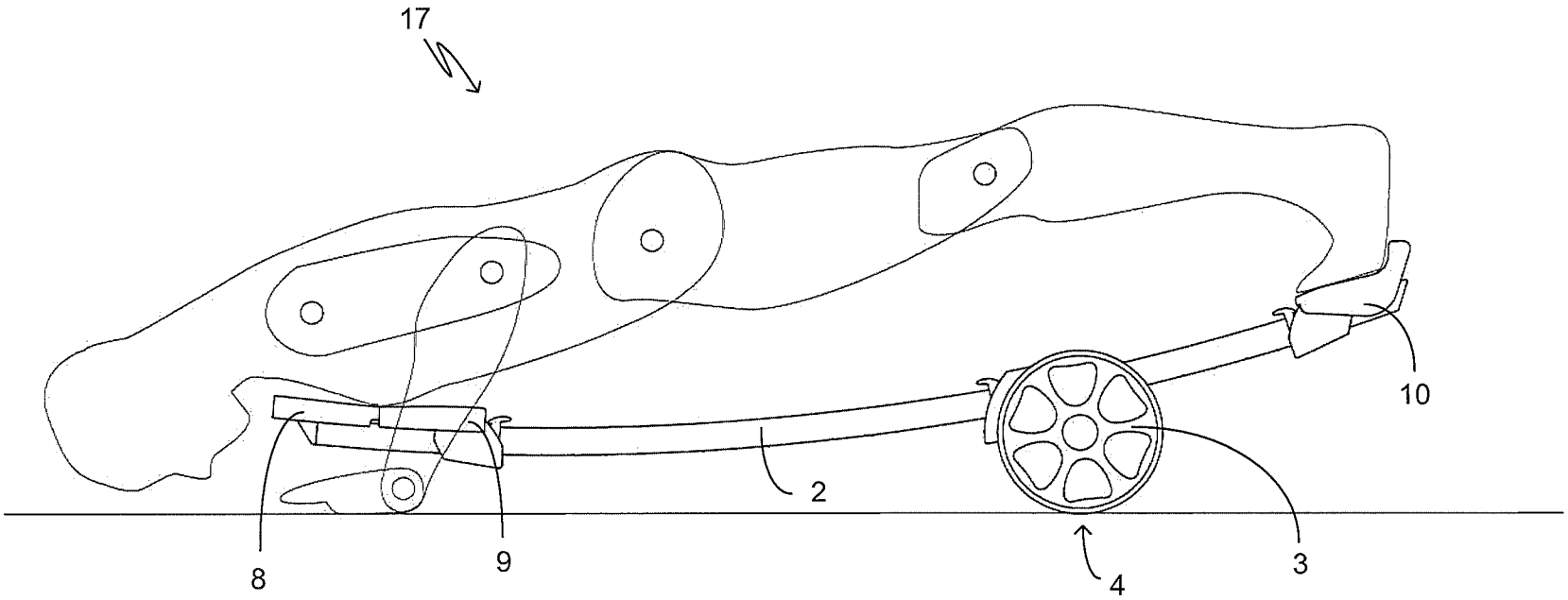
FIG. 6 shows the position of the device and a user, in a push up mode.
Figure 7:
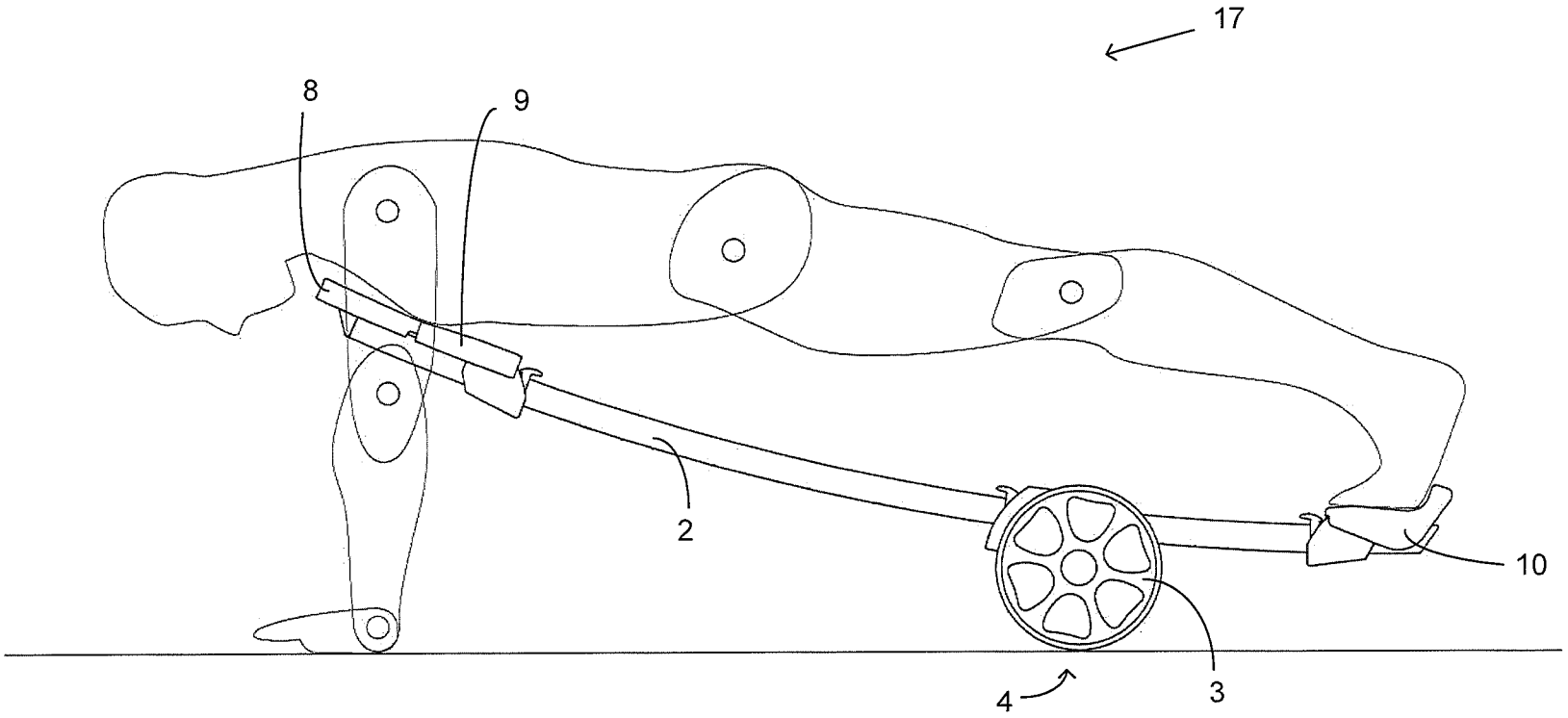
FIG. 7 shows a further position of the device and user, in the push up mode.

FIGS. 6 and 7 illustrate the use of the exercise device 1 in a push up mode, in particular as a push up aid that provides assistance to the user's upwards motion during a push up.

A user 17 adopts a downward-facing position with the user's body arranged along the length of the elongate support element 2. The user's lower body is supported on one or more of the lower body supports. In this case the user's feet are supported on the footrest 10. The user's upper body is supported on one or more of the upper body supports. In this case the first and second upper body supports 8, 9 may be arranged together under the user's chest. The position of the footrest 10 may be adjusted for users of different heights.

In performing the push up motion, the user 17 presses upwards through his or her arms, chest and shoulders, moving from the position of FIG. 6 to that of FIG. 7. The position of the user's centre of gravity relative to the pivot body 3 changes as the pivot body is adjusted along the length of the device 1. This in turn adjusts the level of assistance provided to the user's push up motion. The level of assistance provided to the user increases (and the resistance experienced when doing a push up decreases) as the pivot body is moved towards the user's head.

FIGS. 6 and 7 also show the increased range of motion that is made possible by the upwards curvature of the elongate support 2. This curved support 2 can rotate over a greater range without contacting the ground than a straight support could. This curvature also encourages better posture, at least during push up exercises, because it promotes the correct body alignment or prone position with two contact points of the body against the device 1.

Figure 8:
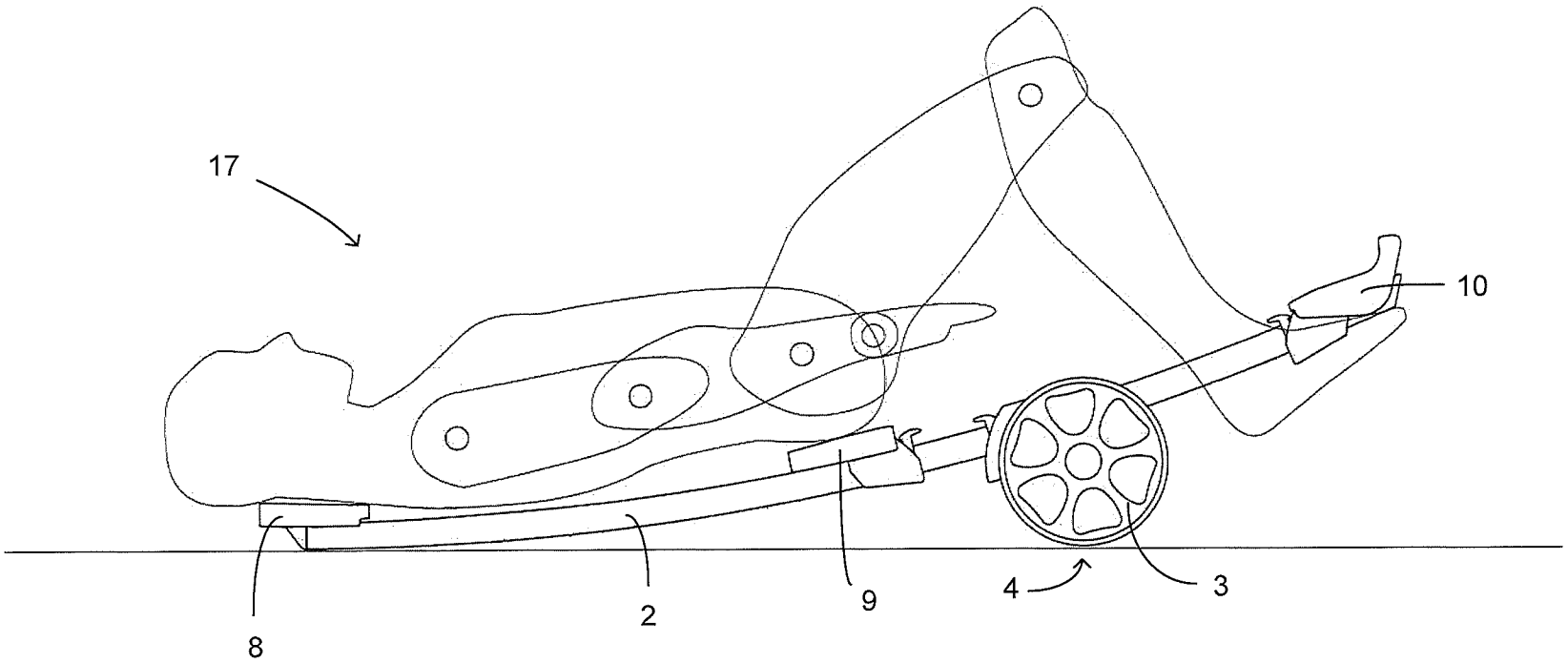
FIG. 8 shows the position of the device and a user, in a sit up mode.
Figure 9:
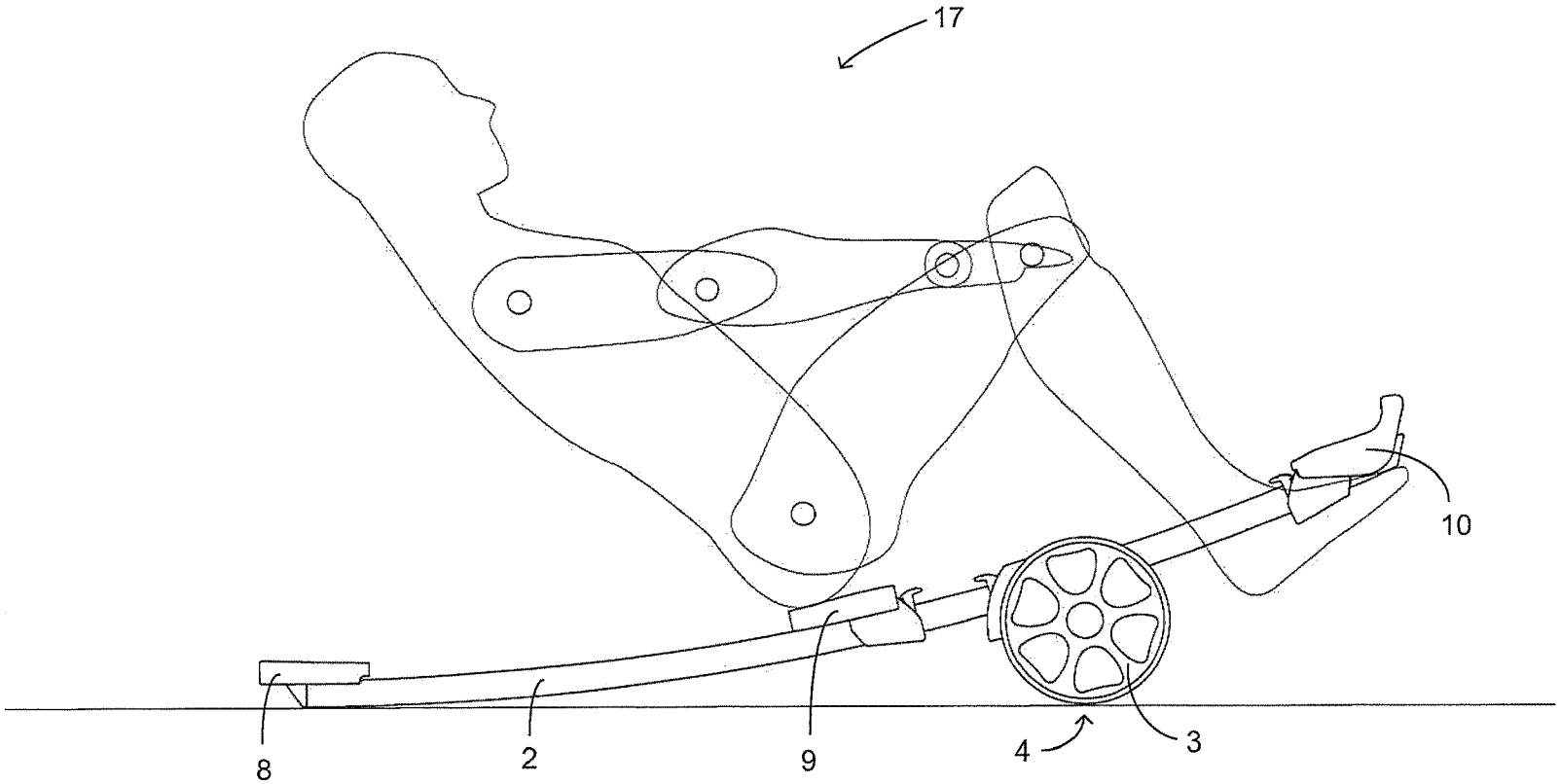
FIG. 9 shows a further position of the device and user, in the sit up mode.

FIGS. 8 and 9 illustrate the use of the exercise device 1 in a sit up mode, in particular as a sit up device that provides an accessible and convenient position in which to perform sit ups.

In this mode, the user 17 sits on one or more of the upper body supports, in this case on the support 9, which has been adjusted to provide the correct distance for a sit up between the user's buttocks and feet. The user's feet may be either rested against the underside of the footrest 10, as shown, or secured to the footrest 10 using straps or the like. This helps to resist incorrect upwards motion of the user's feet during a sit up.

The user moves through a sit up motion from the position of FIG. 8, in which the user's head is supported on one upper body support 8 and their buttocks supported on another upper body support 9, to the position of FIG. 9. Some adjustment of the resistance to this sit up motion is possible by adjustment of the pivot body position, since this alters the incline of the device in the sit up mode; the steeper the incline the greater the resistance.

FIGS. 10 to 13 illustrate an inclined pull up aid system including an exercise aid device 1. The system also includes a pull up frame 20 which includes a base 21 and an overhead framework 22 supported on the base 21. The overhead framework may be of any suitable kind providing one or more overhead grips 23. The overhead grips may be a bar, as shown, or straps, rings or any other suitable grips that a user can hold in his or her hands.

Figure 11:
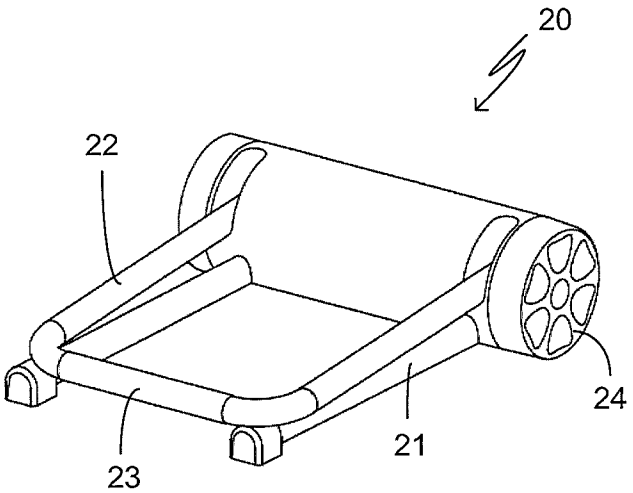
FIG. 11 is a further view of the pull up frame of FIG. 10.
Figure 10:
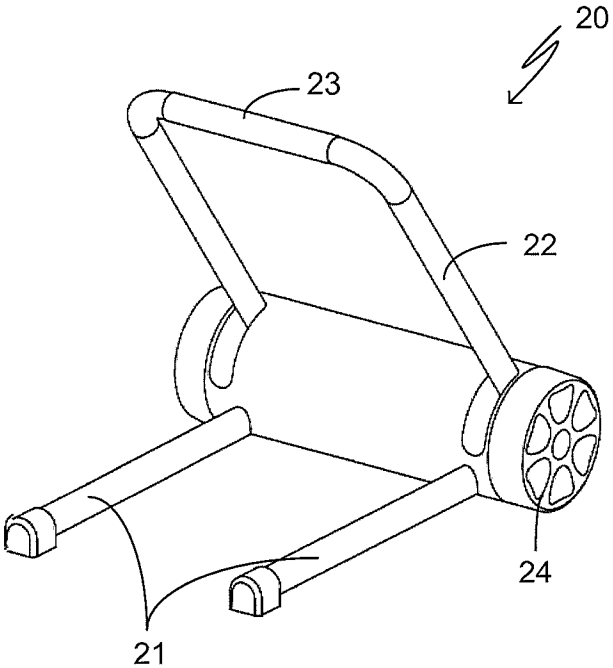
FIG. 10 shows a pull up frame according to one embodiment.

The pull up frame may be collapsible for easy storage, with the overhead framework 22 rotating about a pivot member 24 relative to the base 21, as illustrated by the difference between the "in-use" position of FIG. 10 and the folded position of FIG. 11.

Figure 12:
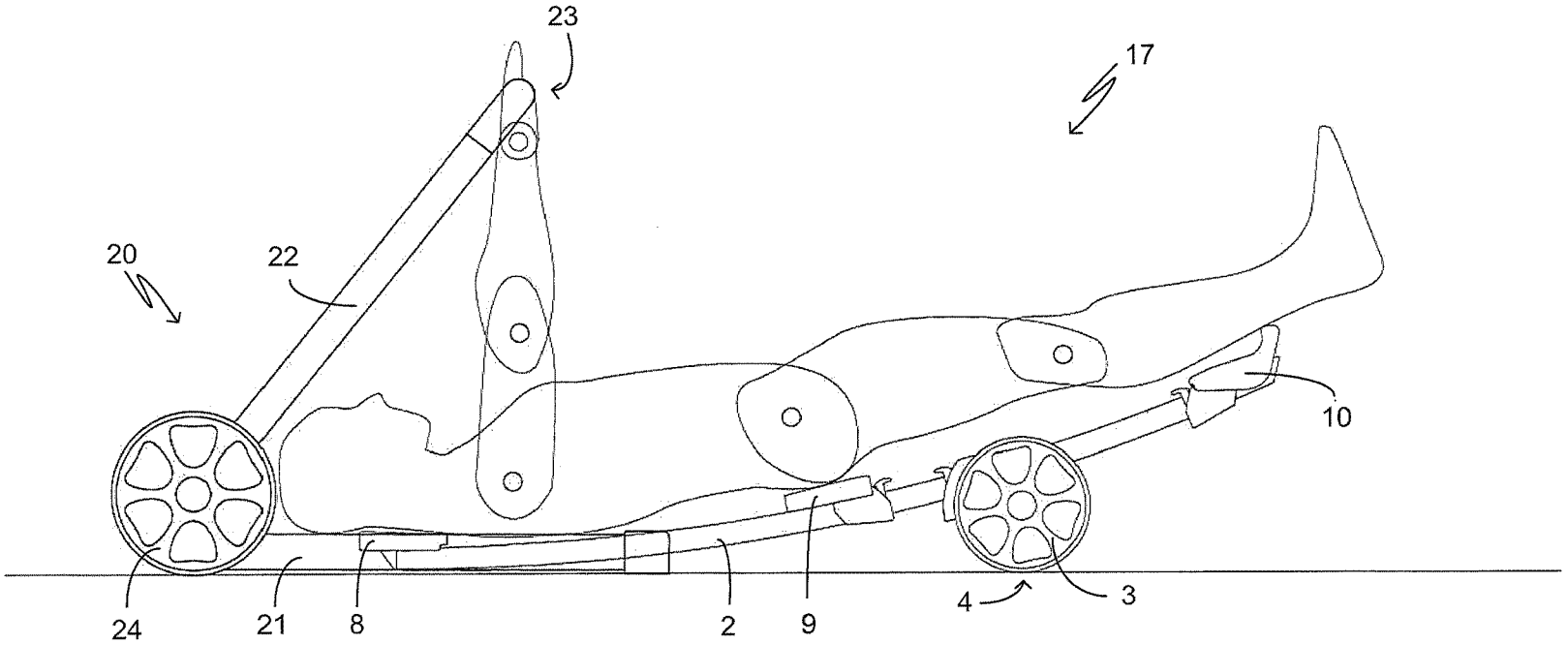
FIG. 12 shows the position of the device, pull up frame and user, in an inverted pull up mode.
Figure 13:
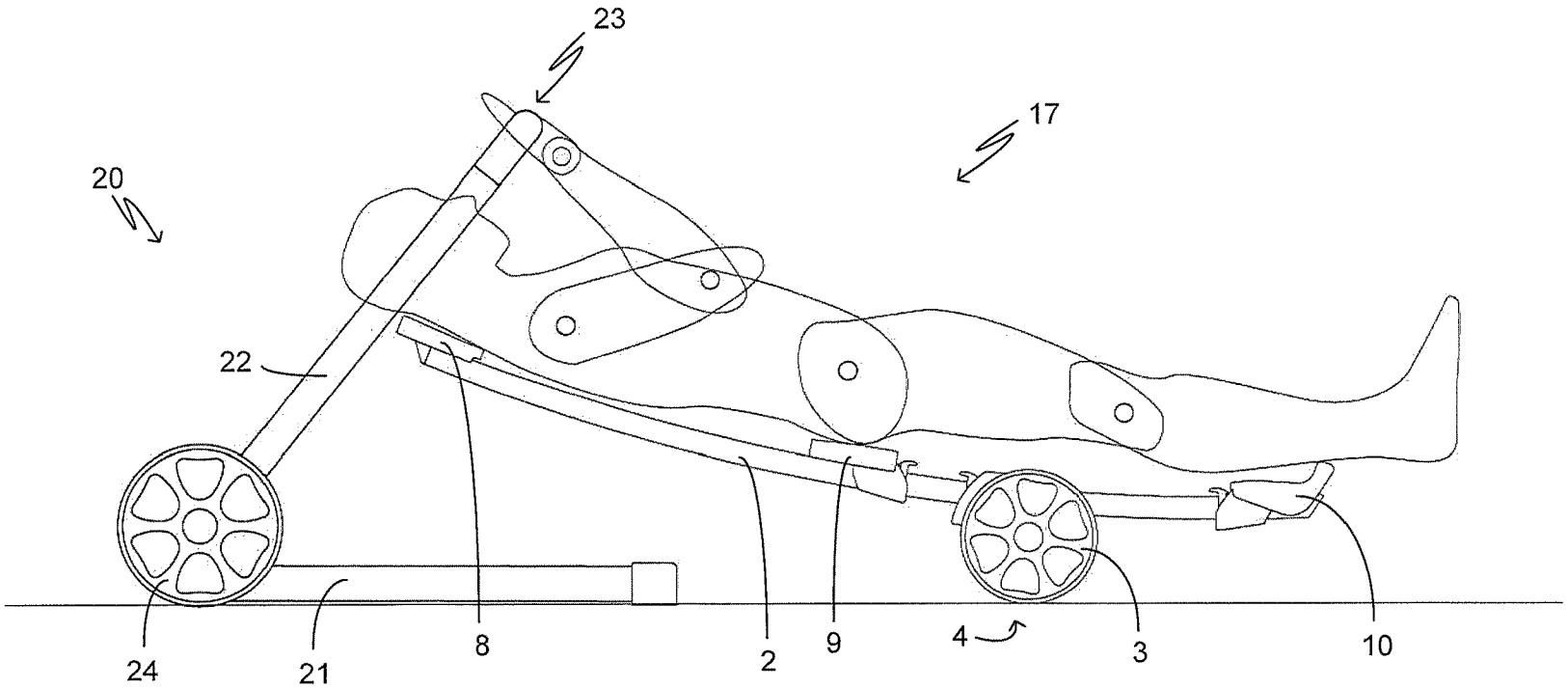
FIG. 13 shows a further position of the device, pull up frame and user, in the inverted pull up mode.

In the inverted pull up mode, the user 17 adopts an upwards-facing position with the user's body arranged along the length of the elongate support element 2, as shown in FIG. 12. The user's lower body is positioned on one or more of the lower body supports 10. The user's upper body is supported on one or more of the upper body supports 8, 9. The user's hands are gripping the one or more overhead grips 23. The user pulls upwardly on the overhead grips 23 to move from the position of FIG. 12 to that of FIG. 13. The level of assistance can be adjusted by altering the position of the pivot body 3 along the length of the device 1. As the pivot body is moved towards the user's head the level of resistance decreases.

Figure 14:
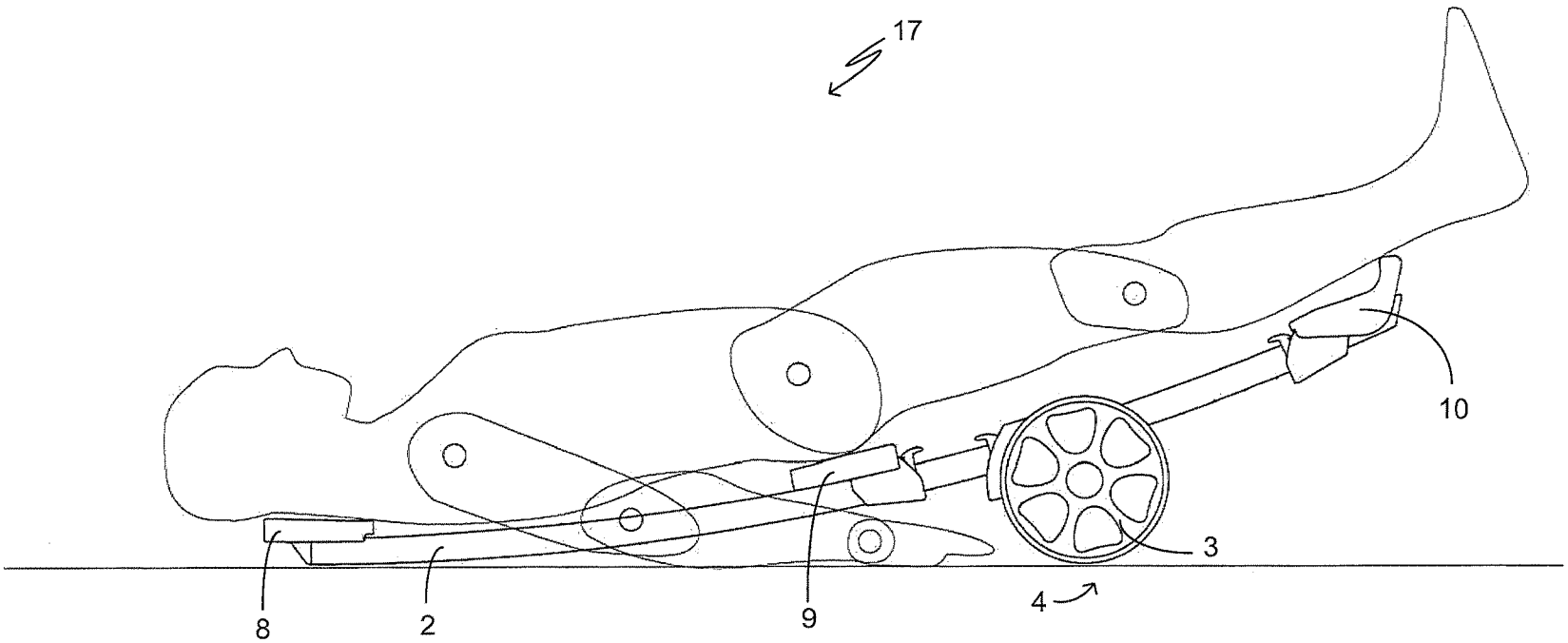
FIG. 14 shows the position of the device and a user, in a leg raise mode.
Figure 15:
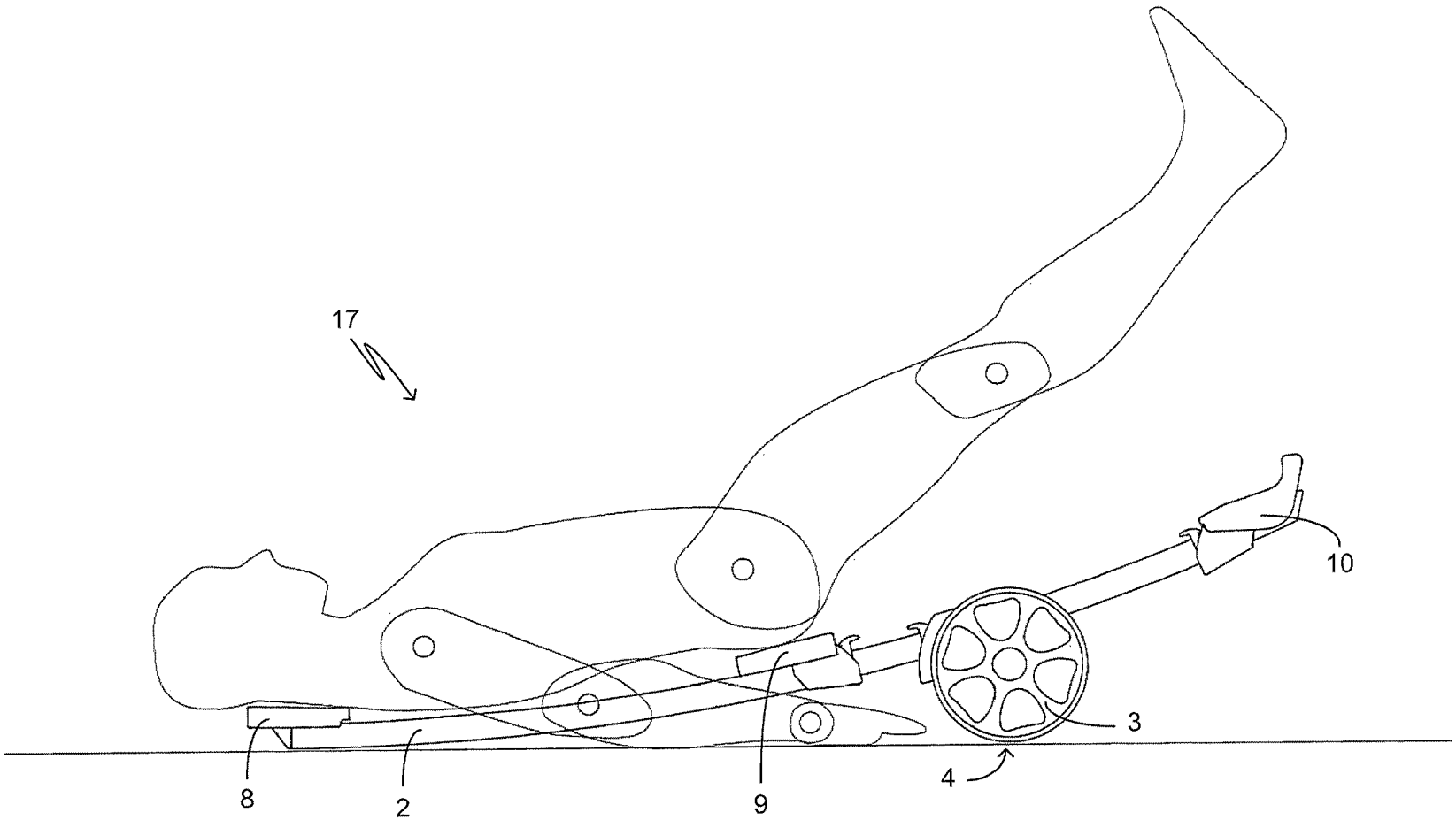
FIG. 15 shows a further position of the device and user, in the leg raise mode.

FIGS. 14 and 15 illustrate the use of the device 1 in a leg raise mode. In this mode, the user 17 adopts an upwards-facing position with the user's body arranged along the length of the elongate support element 2, as shown in FIG. 12. The user's lower body is positioned on one or more of the lower body supports 10. The user's upper body is supported on one or more of the upper body supports 8, 9. The user may then raise their legs from the position of FIG. 14 to that of FIG. 15.

Figure 16:
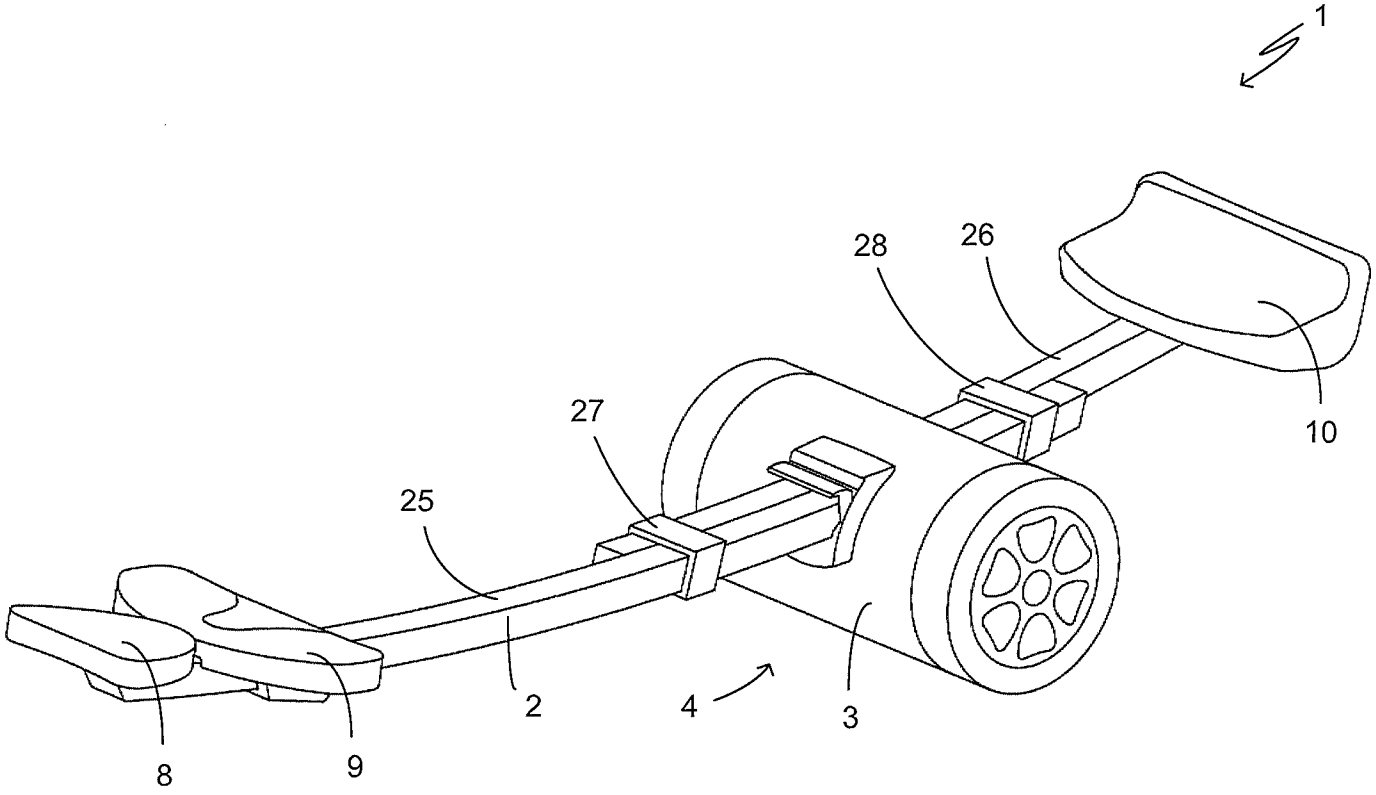
FIG. 16 shows an exercise device according to a further embodiment.
Figure 17:
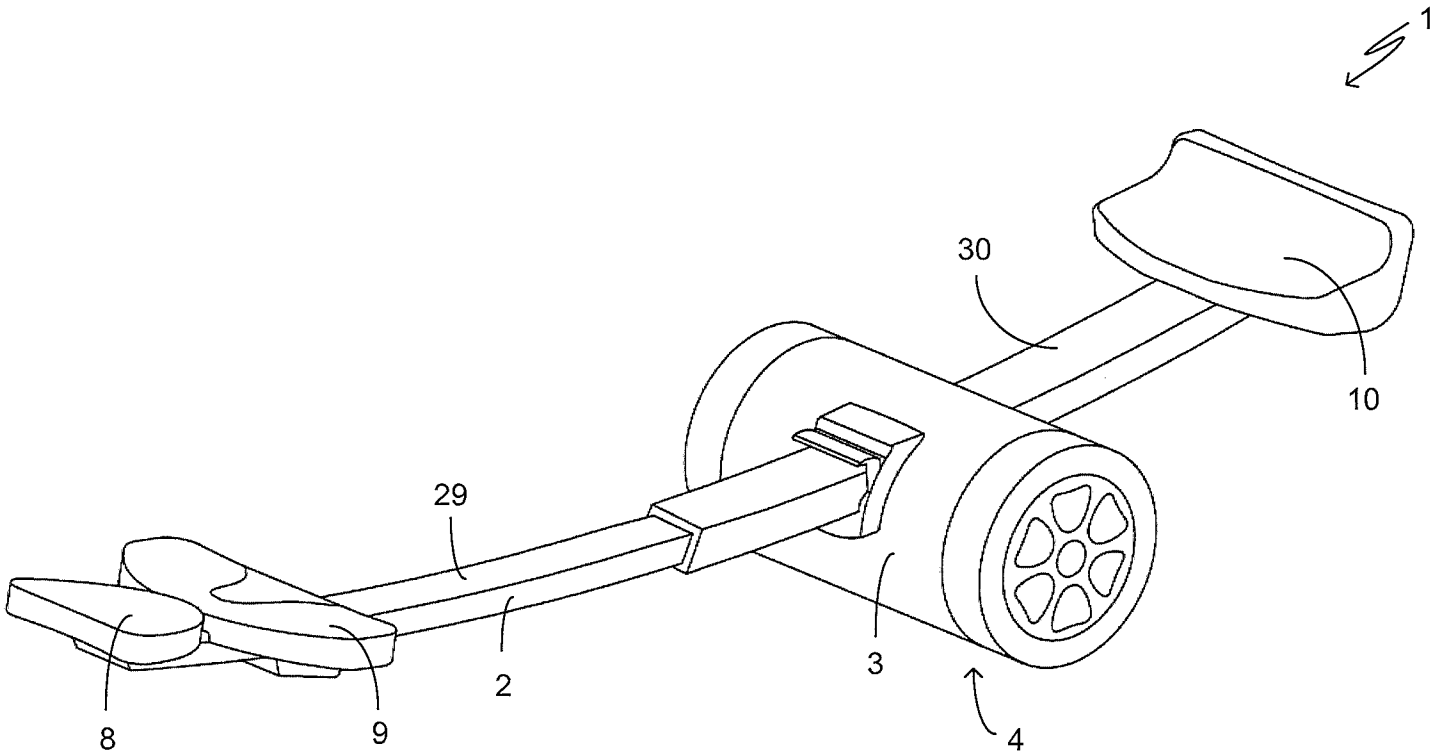
FIG. 17 shows an exercise device according to another embodiment.

FIGS. 16 and 17 illustrate two further embodiments. In each case the elongate support element 2 has an adjustable length. This allows the length of the device to be adjusted for a user's height. In these embodiments the position of the footrest 10 may not be adjustable.

In the embodiment of FIG. 16 the elongate support element 2 includes first and second elongate sections 25, 26, which are arranged side by side and secured to each other by brackets 27, 28.

The overall length of the elongate support element 2 may be adjusted by sliding the first and second elongate sections with respect to each other.

In the embodiment of FIG. 17 the elongate support element 2 includes first and second elongate sections 29, 30 which are arranged in a telescoping manner such that the first section 29 slides within the second section 30.

In either FIG. 16 or FIG. 17 a suitable locking element may be provided to lock the overall length of the elongate support element at a desired setting. In one embodiment the engagement element 13 of the pivot body 3 may be configured to engage with both the first and second elongate sections 25, 26 or 29, 30 to lock the overall length. In other embodiments a separate locking element may be provided.

Figure 18:
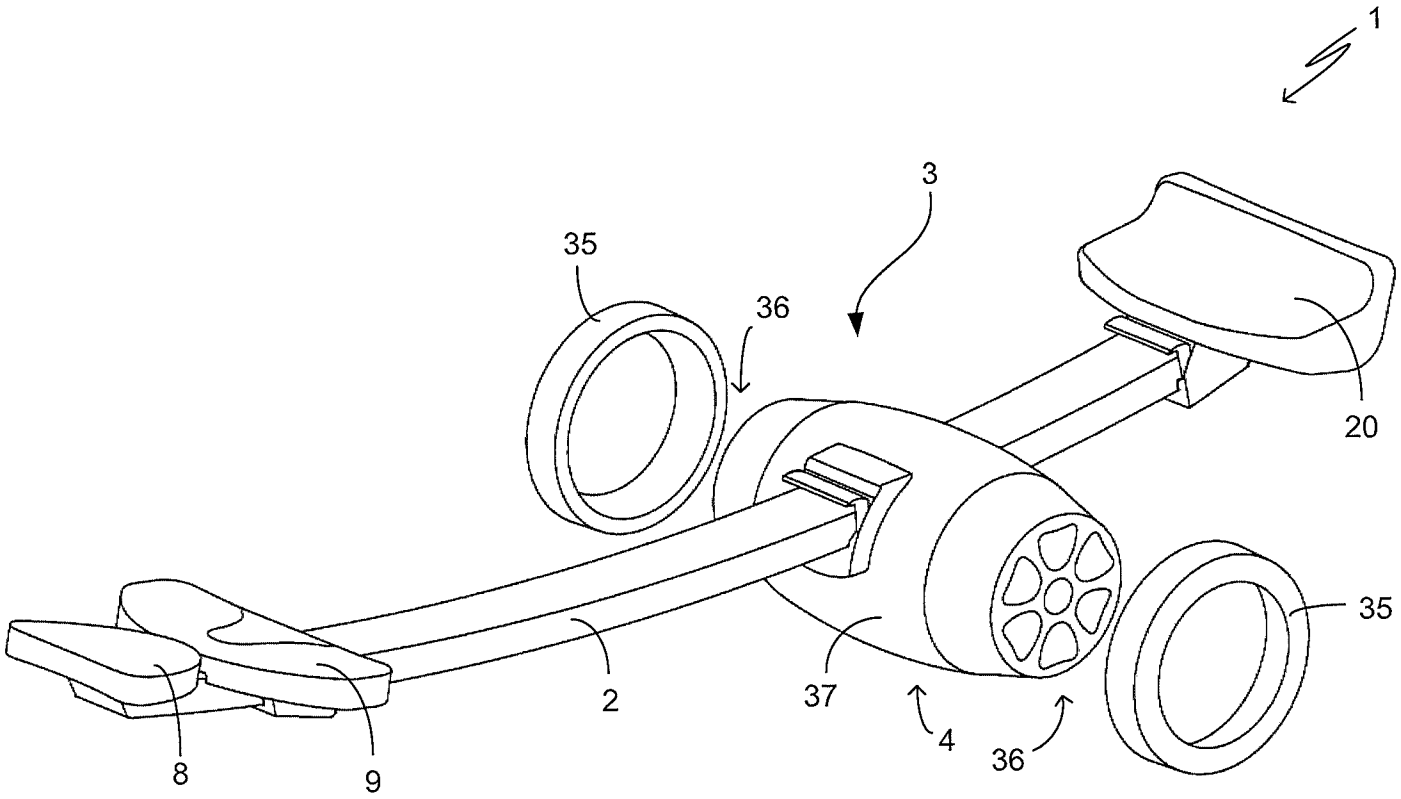
FIG. 18 shows an exercise device according to a further embodiment.

FIG. 18 illustrates a further embodiment of exercise device 1 in which the pivot body 3 has a non-cylindrical shape. In general various shapes may be used to provide different levels of resistance. In the embodiment shown in FIG. 18 the pivot body has the shape of a truncated rugby ball or American football. The pivot body therefore provides a ground bearing surface 4 that has both front to back curvature and side to side curvature. The result of this is that the lateral stability provided by a cylindrical pivot body (as in e.g. FIG. 1) is lost. This lateral instability will engage further muscles during use, in particular the core muscles such as the obliques and transverse abdominus and may also assist in stimulating twitch fibre and triggering muscles.

In general, the pivot body 3 may have any suitable shape. Generally the ground bearing surface 4 may be either a cylindrical surface or an ellipsoidal surface, or may have any suitable combination of such surfaces. Where an ellipsoidal surface is used, it may be any suitable ellipsoidal shape, including tri-axial ellipsoidal, spheroidal or spherical. The curvature of the ground bearing surface may be continuous, or may change. The ground bearing surface may include two or more sections each with a different curvature.

Where a non-cylindrical shape is used, as in FIG. 18, a number of auxiliary pivot body units 35 may be provided. When these are mounted on the ends 36 of the pivot body 3, the combined pivot body 3 and auxiliary pivot body units 35 together provide a cylindrical ground bearing surface 4. This allows the shape of the ground bearing surface to be adjusted between the cylindrical shape and the curvature of the pivot body without the auxiliary pivot body units. In some embodiments several sets of auxiliary pivot body units may be provided, each giving a different curvature of ground bearing surface when installed on the pivot body 3. In the embodiment of FIG. 18 a central region 37 of the pivot body 3 may be formed with a non-slip surface. This functions similarly to the tyres 5 discussed above. Similarly, the circumference of each auxiliary pivot body unit may have a non-slip surface.

The device 1 may also include a repetition counter, which may be any suitable mechanical or electrical device configured to sense a movement of the device 1 through a cycle. For example, an electronic tilt sensor or mechanical clicker could be used. A tilt sensor could be provided using a Smartphone mounted on the device with a suitable bracket. The sensor or clicker may be linked to a suitable counter.

A suitable display may also be provided. The display may be mounted at any suitable point on the device, preferably on the elongate support. The display may display any one or more of: a resistance level (receiving signals from an appropriate sensor for sensing the position of the pivot position); a repetition count; a heart rate (receiving signals from a suitable heart rate monitor); an exercise time (including an accumulated time or a countdown time); and an indication of energy expended.

The device may be formed from any suitable materials. Preferably the materials are relatively light in weight. The elongate support element may be formed from a suitable metal, such as aluminium or steel. The locking mechanisms for filing the positions of adjustable components are preferably formed from metal. Other components may be formed from moulded plastics, with foam used where appropriate for user comfort.

Advantageously, the Applicant's exercise device is configured to provide convenient adjustable resistance without the use of external forces such as spring forces or adjustable weights. In preferred forms the Applicant's device relies solely or predominantly on body weight of the user to provide assistance to the exercise motions. Adjustment of resistance does not require the moving of heavy weights or stretching of springs or elastic bands against strong spring forces.

Further, the Applicant's device is of a simple construction and is comfortable in use, unlike some prior exercise machines. The device itself may be relatively light weight, allowing it to be easily moved around. The device is easily stored away and brought out of storage for use. Further, the device may easily and conveniently be configured for a number of different exercises.

In preferred embodiments discussed above the elongate support element 2 is mounted in an adjustable pivot or roller body 3. However, in some embodiments the elongate support element could be supported by an adjustable pivot supported by a fixed element or framework.

Figures 19, 20:
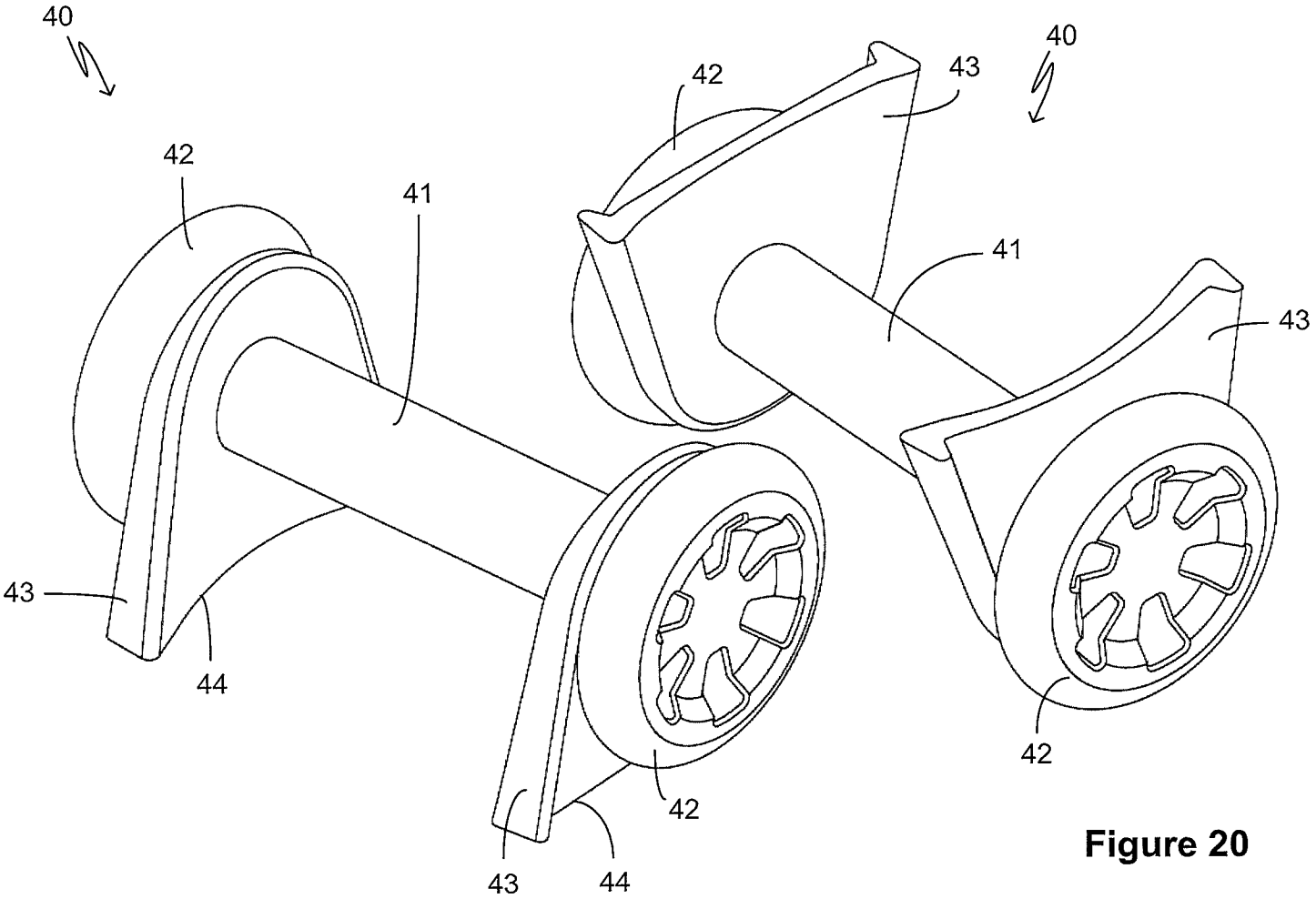
FIG. 19 shows an exercise device according to another embodiment.
FIG. 20 is a further view of the exercise device of FIG. 19.

FIGS. 19 and 20 illustrate a further exercise device 40. The device 40 includes a handle 41 that extends between two spaced apart wheels 42. A support arrangement is also provided, in the form of supports 43. During use either the wheels or the support arrangement will be in contact with the ground or floor, depending on the orientation of the device 40.

In FIG. 19 the device 40 is oriented to operate as a stationary push up handle or similar. The user's weight applied to the handle 41 will be borne through the supports 43 to the ground or floor. As the supports have a stable base 44, the device will not move as the user shifts their weight during exercise.

However, in FIG. 20 the device 40 is oriented to operate as a roller. The user's weight applied to the handle 41 will be borne through the wheels 42 to the ground or floor. As the wheels are mounted to rotate with respect to the handle 41, the device will roll across the ground or floor. This adds useful instability to push ups and similar exercises.

The device 40 may be used in combination with any of the devices of FIGS. 1 to 18 in push up mode. The device 40 may be used singly or in a pair of similar devices 40. The device 40 provides convenient dual functions in a single device.

While the present invention has been illustrated by the description of the embodiments thereof, and while the embodiments have been described in detail, it is not the intention of the Applicant to restrict or in any way limit the scope of the appended claims to such detail. Further, the above embodiments may be implemented individually, or may be combined where compatible. Additional advantages and modifications, including combinations of the above embodiments, will readily appear to those skilled in the art. Therefore, the invention in its broader aspects is not limited to the specific details, representative apparatus and methods, and illustrative examples shown and described. Accordingly, departures may be made from such details without departure from the spirit or scope of the Applicant's general inventive concept.

The invention claimed is:

1. An exercise device, including:

i. an elongate support element;

ii. a pivot adjustably positioned at an intermediate point along the length of the elongate support element, wherein the position of the pivot along the length of the elongate support element is adjustable in order to adjust a level of assistance or resistance provided by the device;

iii. one or more lower body supports mounted on the elongate support element on a first side of the pivot; and iv. one or more upper body supports mounted on the elongate support element on a second side of the pivot.

2. The exercise device as claimed in claim 1, wherein the pivot is provided by a pivot body including a ground bearing surface and being configured to support the elongate support element above the ground, such that, in use, the elongate support element and pivot body move together in a pivoting or rolling motion.

3. The exercise device as claimed in claim 2 wherein the ground bearing surface is a non-slip bearing surface.

4. The exercise device as claimed in claim 2 wherein the ground bearing surface is a substantially cylindrical surface.

5. The exercise device as claimed in claim 2 wherein the ground bearing surface is a substantially ellipsoidal surface.

6. The exercise device as claimed in claim 2 wherein the wherein the pivot body is configured to releasably engage with the elongate support element such that the position of the pivot body along the length of the elongate support element can be adjusted.

7. The exercise device as claimed in claim 1 further including one or more resistance indicators indicative of an exercise resistance level as a function of pivot position along the length of the elongate support element.

8. The exercise device as claimed in claim 1 wherein at least one of the upper and lower body supports has a position that is adjustable along the length of the elongate support element.

9. The exercise device as claimed in claim 1 wherein the elongate support element has a fixed length.

10. The exercise device as claimed in claim 1 wherein the elongate support element has an adjustable length.

11. The exercise device as claimed in claim 1 wherein the elongate support element has at least one region of upwards curvature along its length.

12. The exercise aid device as claimed in claim 1, wherein, in use as a push-up aid device, a user adopts a downward-facing position with the user's body arranged along the length of the elongate support element, the user's lower body positioned on one or more of the lower body supports and the user's upper body supported on one or more of the upper body supports.

13. The exercise aid device as claimed in claim 1, wherein, in use as a sit-up device, a user sits on one or more of the upper body supports with the user's body arranged along the length of the elongate support element and the user's feet positioned beneath or secured to one or more of the lower body supports.

14. An inclined pull up aid system including the exercise aid device as claimed in claim 1 and one or more overhead grips, wherein, in use, a user adopts an upwards-facing position with the user's body arranged along the length of the elongate support element, the user's lower body positioned on one or more of the lower body supports, the user's upper body supported on one or more of the upper body supports and the user's hands gripping the overhead grips.

15. The exercise device as claimed in claim 1 wherein the device is configurable as a push up aid.

16. The exercise device as claimed in claim 1 wherein the device is configurable as a sit up device.

17. The exercise device as claimed in claim 1 wherein the device is configurable as an inverted pull up device.

18. The exercise device as claimed in claim 1 wherein all assistance to user motion is derived from body weight and/or from fixed weight of components of the device.

19. The exercise device as claimed in claim 1 wherein the one or more lower body supports include a footrest.

20. The exercise device as claimed in claim 1 wherein the one or more upper body supports include a first support having a position that is adjustable along the elongate support element and a second support, the first support being positioned between the second support and the pivot.

* * * * *